US008684631B2

(12) United States Patent
Bolotte, Jr.

(10) Patent No.: US 8,684,631 B2
(45) Date of Patent: Apr. 1, 2014

(54) CONCRETE FORM ELEVATED SITE (CFES)

(75) Inventor: Wade Bolotte, Jr., Lovington, LA (US)

(73) Assignee: CenturyLink Intellectual Property LLC, Denver, CO (US)

( * ) Notice: Subject to any disclaimer, the term of this patent is extended or adjusted under 35 U.S.C. 154(b) by 450 days.

(21) Appl. No.: 12/111,686

(22) Filed: Apr. 29, 2008

(65) Prior Publication Data

US 2009/0269148 A1 Oct. 29, 2009

(51) Int. Cl.
*E02D 27/00* (2006.01)

(52) U.S. Cl.
USPC ..... 405/229; 405/232; 52/296; 52/169.5

(58) Field of Classification Search
USPC ..... 405/229, 231, 232, 251, 252, 256, 257; 52/169.4, 169.5, 295, 296, 40, 745.04, 52/745.18
See application file for complete search history.

(56) References Cited

U.S. PATENT DOCUMENTS

| | | | | |
|---|---|---|---|---|
| 1,734,777 | A * | 11/1929 | Pike | 52/169.5 |
| 4,089,142 | A * | 5/1978 | Kachadorian | 237/1 R |
| 5,183,694 | A * | 2/1993 | Webb | 205/734 |
| 5,788,423 | A * | 8/1998 | Perkins | 405/284 |
| 6,131,349 | A * | 10/2000 | Hill | 52/292 |
| 6,256,960 | B1 * | 7/2001 | Babcock et al. | 52/592.1 |
| 6,698,710 | B1 * | 3/2004 | VanderWerf | 249/216 |
| 6,702,522 | B2 * | 3/2004 | Silber | 405/229 |
| 2003/0033773 | A1 * | 2/2003 | Houpapa et al. | 52/299 |
| 2003/0056462 | A1 * | 3/2003 | Roy, Sr. | 52/741.13 |
| 2003/0131544 | A1 * | 7/2003 | Miller | 52/169.1 |
| 2006/0048471 | A1 * | 3/2006 | Lee | 52/296 |

FOREIGN PATENT DOCUMENTS

| | | | | |
|---|---|---|---|---|
| JP | 10110441 | A * | 4/1998 | E02D 27/34 |

* cited by examiner

*Primary Examiner* — Benjamin Fiorello
(74) *Attorney, Agent, or Firm* — Swanson & Bratschun, L.L.C.

(57) ABSTRACT

A method for creating an elevated containment structure at a site for providing telecommunications services. The elevated containment structure defines a containment field that is substantially surrounded by at least one wall of the elevated containment structure. The creation of the elevated containment structure further comprises forming the at least one wall, disposing a fill material within the containment field, positioning an equipment pad on the fill material, positioning telecommunications equipment on the equipment pad, receiving a signal at the telecommunications equipment from either end user and a service provider, communicating the signal from the equipment to the other of the end user and the service provider. Forming the at least one wall comprises positioning a plurality of forms to create a gap between at least two of the forms and disposing a second fill material in the gap.

20 Claims, 2 Drawing Sheets

CONCRETE FORM ELEVATED SITE (CFES)

BACKGROUND OF THE INVENTION

Telecommunications companies have been building remote telecommunications equipment sites (remote sites) for many years. The remote sites allow for electronic equipment, which is necessarily or preferably located near end users, to be located much closer to an end user than a central office location would customarily allow. Some examples of the types of equipment that may be required to be within close proximity to end users include, but are not limited to, Digital Subscriber Line (DSL) equipment, fiber optic node equipment for expanding high definition (HD) capability, cell towers, as well as many others.

The remote sites generally include one or more metal cabinet-type housings that can range in size, for example, from 2'×4' up to a 6'×8', depending on the type and amount of equipment required for a particular location. In some instances, the housings may be located directly on a hard surface, such as a concrete pad, at ground level. Frequently, however, the ground level is prone to flooding or other environmental conditions that require the site to be elevated.

A few methods have been used in the past for elevating electronic telecommunications equipment sites. Forming ledges out of dirt into berms, using timber to raise the elevation of the equipment, or constructing block walls are all time consuming and relatively expensive methods that are common today. Across some parts of the United States, using an elevated metal platform, similar in appearance to a miniature oil-rig, has become widely accepted as the industry standard. These elevated metal platforms are not very aesthetically pleasing, can be time consuming to construct, and generally lack design flexibility.

BRIEF SUMMARY OF THE INVENTION

To provide telecommunications companies with an improved alternative to current methods for telecommunications equipment site elevation, one or more embodiments of the present invention may be implemented.

One embodiment includes a method of providing telecom services. The method comprises creating an elevated containment structure at a site for providing telecommunications services. The elevated containment structure defines a containment field that is substantially surrounded by at least one wall of the elevated containment structure. The creation of the elevated containment structure further comprises forming the at least one wall, disposing a fill material within the containment field, positioning an equipment pad on the fill material, positioning telecommunications equipment on the equipment pad, receiving a signal at the telecommunications equipment from either end user and a service provider, communicating the signal from the equipment to the other of the end user and the service provider. Forming the at least one wall comprises positioning a plurality of forms to create a gap between at least two of the forms and disposing a second fill material in the gap.

Another embodiment includes a method of installing telecommunications equipment. The method comprises creating an elevated containment structure at a site for providing telecommunications services. The elevated containment structure defines a containment field that is substantially surrounded by at least one wall of the elevated containment structure. The creation of the elevated containment structure further comprises positioning a plurality of forms to create a gap between at least two of the forms, disposing concrete in the gap, disposing a fill material within the containment field, positioning an equipment pad on the fill material, and positioning telecommunications equipment on the equipment pad.

BRIEF DESCRIPTION OF THE DRAWINGS

Illustrative embodiments of the present invention are described in detail below with reference to the attached drawing figures, which are incorporated by reference herein and wherein.

DETAILED DESCRIPTION OF THE INVENTION

Figure 1:
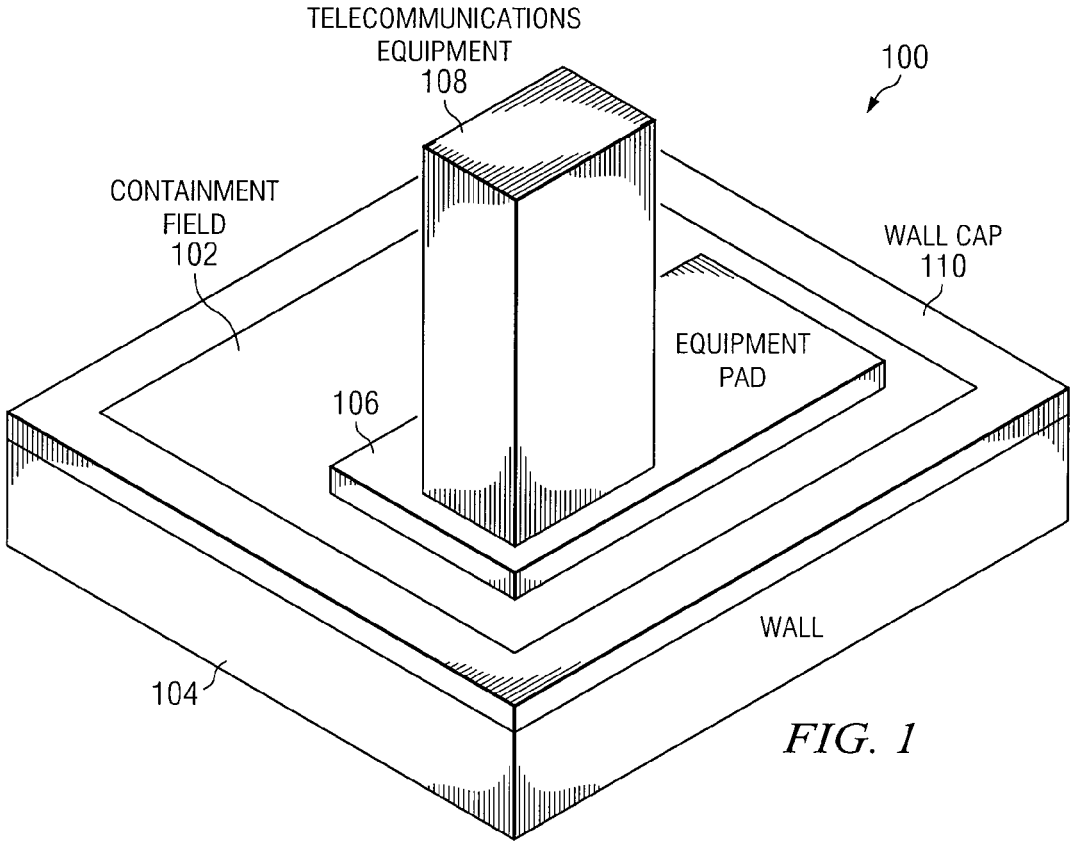
FIG. 1 is an illustration of one embodiment of an elevated containment structure.

FIG. 1 is an illustration of one embodiment of an elevated containment structure 100 that may be created in a remote location for providing telecommunications services. For the purposes of the present invention, any location that is not part of a central office, as such term is commonly known in the art, may be considered a remote location. Elevated containment structure 100 includes at least one wall 104, the at least one wall 104 defining a containment field 102. An equipment pad 106 is disposed outwardly from the containment field 102 and supports telecommunications equipment 108. A wall cap 110 is positioned on top of the at least one wall 104. In one embodiment, the containment field 102 is filled with flooded sand topped with mat and base stone. In an alternative embodiment, any other fill material suitable for forming a foundation within the containment field 102 may also be used. For purposes of this application, fill material shall mean concrete, flooded sand, compressed granite, gravel, stone, or any other suitable material or materials for forming a foundation, support, or barrier.

In one embodiment, the at least one wall 104 that defines the containment field 102 is constructed from one of a plurality of forms (not shown) made of expanded polystyrene around a nylon web. However, the forms may also be made of wood or any other suitable material. The one of a plurality of forms will be described in greater detail below in reference to FIG. 2. The exterior of the at least one wall 104 may be dressed in HardiePlank™, vinyl siding, wood siding, or any other type of siding material. Providing an exterior treatment to the at least one wall 104 may allow for the elevated containment structure 100 to be more aesthetically pleasing than previously used elevation methods.

The equipment pad 106 constructed with concrete or any other suitable material capable of supporting telecommunications equipment 108 is positioned, for example, on or near the top of the fill material and may be at a height that is level with a wall cap 110.

The telecommunications equipment 108 may be any type of equipment utilized by telecommunication providers at facility distribution points. Some exemplary telecommunications equipment 180 includes, but is not limited to, Tellabs MESA 2, 4, 6 cabinets, Emerson medium and small cabinets, Alcatel/Lucent ALP 248 cabinets, CommScope medium and small cabinets, Onan Generators, Katolight Generators, and Emerson power supply cabinets. Any combination of these or other telecommunications equipment may be utilized within the scope of the present invention.

The wall cap 110 is located on top of the at least one wall 104. In one embodiment, the wall cap 110 may be 13 inches wide by 2 inches high. In alternative embodiments, other dimensions may be used for the wall cap 110. The wall cap 110 may provide aesthetic value as well as functional value, such as providing a boundary for the fill material in the containment field 102.

Figure 2:
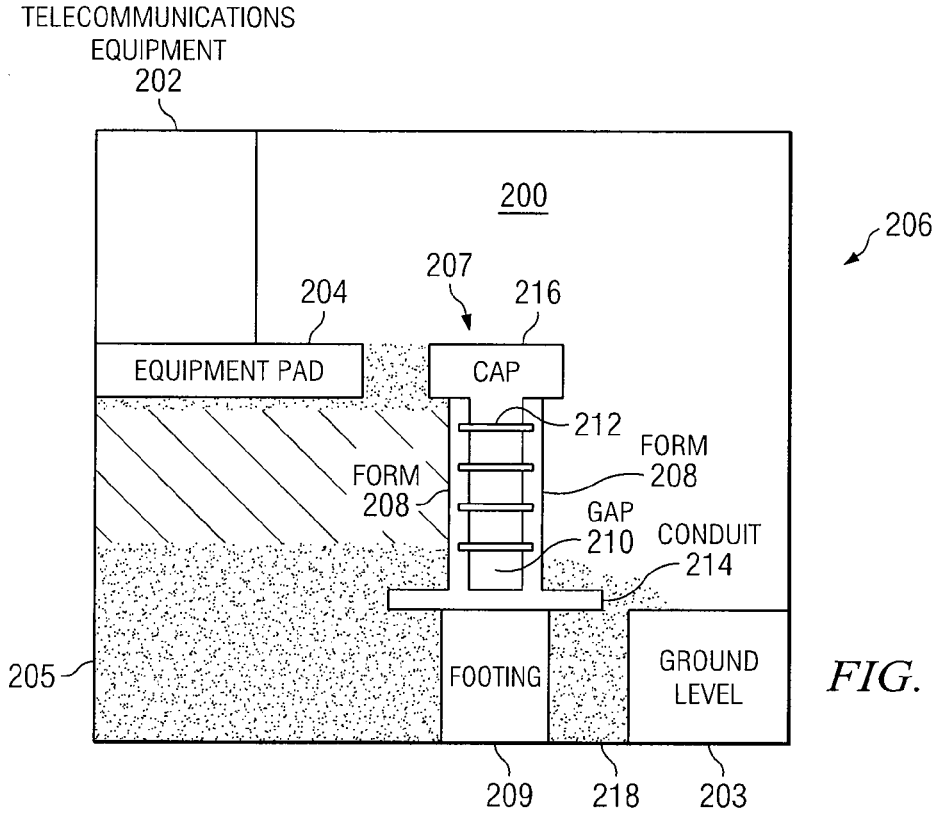
FIG. 2 is an illustration of one embodiment of a cross section of an elevated containment structure.

FIG. 2 is an illustration of a cross section of one embodiment of an elevated containment structure 200. The elevated containment structure 200 is used for raising telecommunications equipment 202 from ground level 203. Telecommunications equipment 202 may include any of the equipment previously described in FIG. 1. Frequently, the telecommunications equipment 202 may include fiber to the curb equipment, or a combination of digital loop carrier and fiber to the curb equipment, but any type of telecommunications equipment 202 may be used.

Telecommunications equipment 202 is placed on an equipment pad 204 that extends outwardly from a portion of fill material 205 contained in a containment field 206. The equipment pad 204 may be the same as has already been described in FIG. 1. In one embodiment, the fill material 205 may be any combination of flooded sand topped with mat and base stone, gravel, sand, or any other type of material that is capable of supporting the equipment pad 204 and the telecommunications equipment 202 within the lateral dimensions of the containment field 206. The containment field 206 is bordered by at least one wall 207 that surrounds the containment field 206. The at least one wall 207 may be constructed by positioning a plurality of forms 208 to create a gap 210 between at least two of the forms 208.

The forms 208 are constructed using expanded polystyrene around a nylon web, wood, or any other material capable of creating a gap 210 as described in the invention. In one embodiment, the forms 208 may be 8 feet long by 18 inches wide with the gap 210 being anywhere from 4 inches to 12 inches. In an exemplary embodiment, the gap 210 may be 6 inches wide. However, the invention is not limited to a particular gap size or shape of the forms 208.

The gap 210 is filled with concrete or other fill material suitable to create a structurally solid barrier. The gap 210 may also contain reinforcement bars (rebar) 212 between the at least two forms 208 for providing strength to the elevated containment structure 200. In an exemplary embodiment, the rebar 212 may be ½ inch horizontal and vertical rebar. However, rebar 212 of any other size and orientation may also be used in accordance with principles of the present invention.

A footing 209 may be placed on each corner of the elevated containment structure 200. In one embodiment, the footings 209 may be 12 inches wide by 12 inches long by 18 inches deep and act to anchor the elevated containment structure 200 in place. However, other dimensions for the footings may also be used and still be within the scope of the present invention. The footings 209 may be placed in additional locations along the wall 207 when additional support is needed, such as particularly long walls 207. The walls 207 and the footings 209 may be poured at the same time using, for example, 3000 psi 6-inch slump concrete.

Before pouring the concrete for the wall 207, a conduit 214, such as a "French drain," may be placed through the form 208 to assist in drainage of the containment field 206. In one embodiment, the conduit 214 may be placed near or at the ground level 203 and span at least the width of the wall 207 so that water may drain from the containment field 206. In one embodiment, at least one conduit 214 may be located on each wall 207 of the elevated containment structure 200. Conduits 214 may be made from a variety of materials, including but not limited to, plastic, PVC, and metal.

A cap 216 made of concrete may be formed on top of the wall 207. In one embodiment, the cap 216 may be 2 inches high and 13 inches wide. However, other dimensions may be used. The cap 216 may serve as a barrier to keep in the fill material 205, as a ledge for allowing a person to walk around the containment field 206, or any other functional reason, but the cap 216 may also be used for aesthetic reasons.

Between the wall 207 and the ground 203 may be a layer of exterior fill material 218. The exterior fill material 218 may more easily allow for absorption of water draining from the conduit 214. The exterior fill material 218 may be gradually graded away from the wall 207 to add to the drainage abilities.

Figure 3:
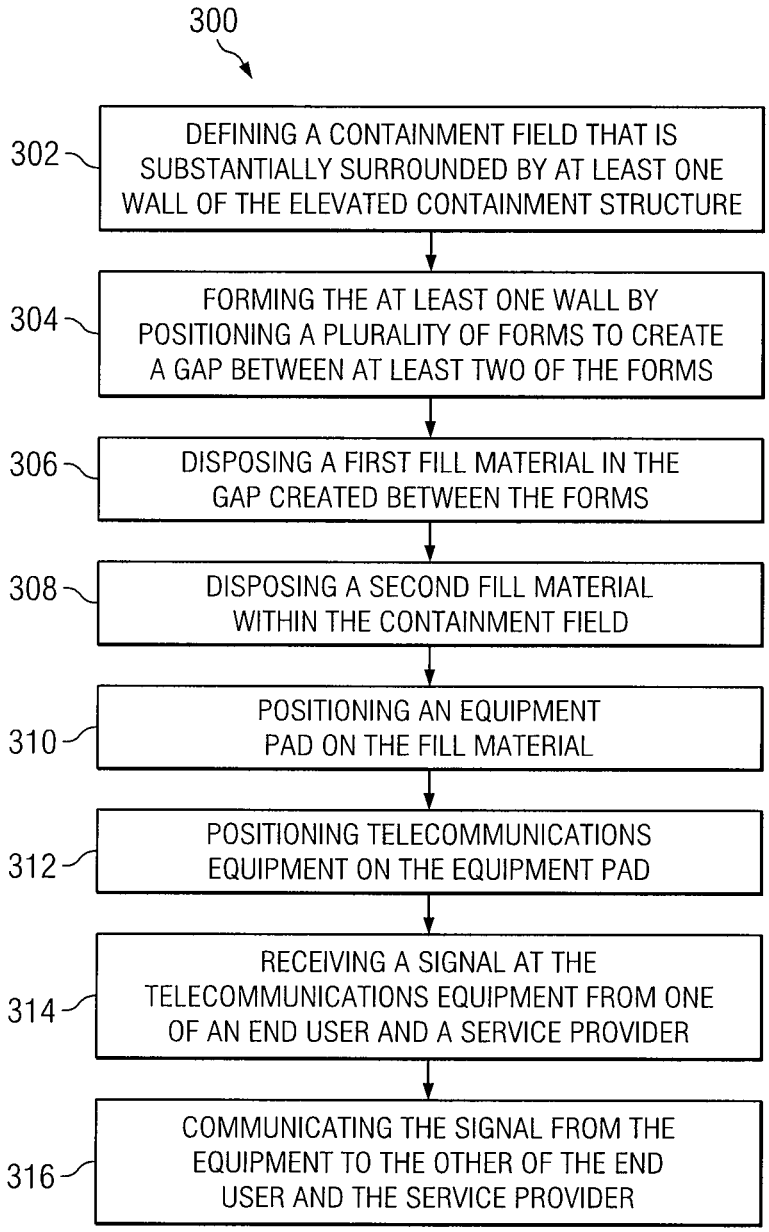
FIG. 3 is a flow diagram of one embodiment of a process of creating an elevated containment structure.

FIG. 3 is a flow diagram of an exemplary process of providing telecommunication services. The process for providing telecommunications services comprises creating an elevated containment structure at a site. The elevated containment structure defines a containment field that is substantially surrounded by at least one wall of the elevated containment structure in step 302. The containment field may be composed of any fill material suitable for supporting the telecommunications equipment, as described previously. The at least one wall may be formed by positioning a plurality of forms to create a gap between at least two of the forms, in step 304. In step 306, a first fill material may be disposed in the gap created between the forms. The fill material, placed in the gap may be concrete, flooded sand, compressed granite, gravel, stone, or any other suitable material or materials for forming a support or barrier. A second fill material may be disposed within the containment field in step 308. The fill material located in the containment field may be concrete, flooded sand, compressed granite, gravel, stone, or any other suitable material or materials for forming a foundation or support. In step 310, an equipment pad may be positioned on the fill material. The positioning may be deep into the containment field or located near the surface. In step 312, telecommunications equipment may be positioned on the equipment pad. A number of different types of telecommunications equipment may be positioned there, as described earlier. A signal may be received at the telecommunications equipment from one of an end user and a service provider at step 314. The signal may be any type of communication ordinarily communicated by telecommunications equipment. The signal from the equipment to the other of the end user and the service provider may be communicated at step 315.

The previous detailed description is of a small number of embodiments for implementing the invention and is not intended to be limiting in scope. One of skill in this art will immediately envisage the methods and variations used to implement this invention in other areas than those described in detail. The following claims set forth a number of the embodiments of the invention disclosed with greater particularity.

What is claimed as new and desired to be protected by Letters Patent of the United States is:

1. A method of providing telecommunication services, the method comprising:

creating an elevated containment structure at a site for providing telecommunications services, the elevated containment structure defining a containment field of loose materials that is substantially surrounded by walls of the elevated containment structure, wherein the creation of the elevated containment structure further comprises:

forming the walls above a ground level, comprising:

positioning a plurality of forms to create a gap between at least two of the forms; and positioning at least one conduit through the gap to drain water from the containment field through each of the walls;

disposing a layer of exterior fill material between the walls and the ground;

disposing a first fill material in the gap;

disposing a second fill material within the containment field, the second fill material being the loose material;

positioning an equipment pad on a portion of the second fill material, a portion of the second fill material being level with the equipment pad around a periphery of the equipment pad, wherein the equipment pad is supported entirely by the second fill material and the equipment pad is not in physical contact with any portion of the walls;

positioning telecommunications equipment on the equipment pad;

receiving a signal at the telecommunications equipment from one of an end user and a service provider; and communicating the signal from the equipment to the other of the end user and the service provider.

2. The method of claim 1, wherein creating the elevated containment structure further includes creating footings on at least each corner of the elevated containment structure to support the walls, and wherein a portion of the second fill material is above the ground level.

3. The method of claim 1, wherein the conduit is a french drain positioned approximately at ground level and spanning a width of each of the walls of the containment structure, and wherein the second fill material covers an entire planar surface within the elevated containment structure.

4. The method of claim 1, wherein positioning the plurality of forms includes positioning forms that are constructed using expanded polystyrene around a nylon web, and wherein an exterior of the walls includes a siding material enhancing the aesthetics of the elevated containment structure.

5. The method of claim 4, wherein the siding material is one of expanded polystyrene around a nylon web vinyl siding, and wood siding.

6. The method of claim 1, wherein creating the elevated containment structure further includes creating a cap along the top of the walls, the cap being flush with the equipment pad and a portion of the second fill material surrounding the periphery of the equipment pad.

7. The method of claim 1, wherein positioning telecommunications equipment on the equipment pad further includes positioning remote terminal equipment including digital loop carrier equipment.

8. The method of claim 1, wherein the fill material is flooded sand layered on top with stone.

9. A method of installing telecommunications equipment, the method comprising:

creating an elevated containment structure at a site for providing telecommunications services, the elevated containment structure defining a containment field of loose materials that is substantially surrounded by walls of the elevated containment structure positioned above a ground level, wherein the creation of the elevated containment structure further comprises:

positioning a plurality of forms to create a gap between at least two of the forms;

positioning at least one conduit through the gap of the elevated containment structure to drain water from the containment field through each of the walls;

disposing concrete in the gap to create the walls;

disposing a layer of exterior fill material between the walls and the ground;

loosely disposing a fill material within the containment field, a portion of the fill material being above the ground level;

positioning an equipment pad on a portion of the fill material, wherein the equipment pad is supported entirely by the fill material and the equipment pad is not in physical contact with any portion of the walls;

creating a cap along the top of the walls, the cap being substantially flush with the equipment pad and the fill material surrounding the equipment pad; and positioning telecommunications equipment on the equipment pad.

10. The method of claim 9, wherein creating the elevated containment structure further includes creating footings on at least each corner of the elevated containment structure to support the walls.

11. The method of claim 9, wherein creating the elevated containment structure further comprises:

constructing the conduit to span a width of each of the walls of the containment structure, wherein the conduit is a french drain positioned approximately at ground level; and disposing the exterior fill material around the elevated containment structure for absorbing water drained through the conduit.

12. The method of claim 9, wherein positioning the plurality of forms includes positioning forms that are constructed using expanded polystyrene around a nylon web.

13. The method of claim 9, wherein creating the elevated containment structure further includes applying a dressing to one or more exterior walls of the elevated containment structure to enhance aesthetics of the elevated containment structure.

14. The method of claim 13, wherein the dressing is one of expanded polystyrene around a nylon web, vinyl siding, and wood siding.

15. The method of claim 9, wherein positioning telecommunications equipment on the equipment pad further includes positioning remote terminal equipment including digital loop carrier equipment, the fill material being flooded sand topped with rock.

16. An elevated telecommunications platform comprising:

an elevated containment structure at a site for providing telecommunications services, the elevated containment structure defining a containment field of loose materials that is substantially surrounded by a plurality of walls of the elevated containment structure, the plurality of walls being above ground level and supported by a plurality of footings;

the plurality of walls being formed from positioning a plurality of forms to create a gap between at least two of the forms, with concrete disposed within the gap;

a layer of exterior fill material between the walls and the ground;

a cap of concrete disposed on top of the plurality of walls to contain a fill material;

the fill material being at least partially loosely disposed within the containment field;

an equipment pad positioned on a portion of the fill material, wherein the equipment pad is supported entirely by the fill material and the equipment pad is not in physical contact with any portion of the walls; and wherein the loose materials of the fill material is level with the equipment pad and surrounds the equipment pad; and telecommunications equipment positioned on the equipment pad.

17. The elevated telecommunications platform of claim 16, further comprising a conduit.

18. The elevated telecommunications platform of claim 17, wherein the fill material is flooded sand layered on top with stone, and wherein a periphery of the elevated containment structure includes the exterior fill material for absorbing water drained from the elevated containment structure by the conduit.

19. The elevated telecommunications platform of claim 17, wherein the conduit is a French drain spanning a width of each of the plurality of walls.

20. The elevated telecommunications platform of claim 16, wherein the cap, the loose materials of the fill material and the equipment pad are substantially flush, and wherein the fill material covers an entire planar surface of the elevated containment structure.

* * * * *